US008783307B2

(12) United States Patent
Ding

(10) Patent No.: US 8,783,307 B2
(45) Date of Patent: Jul. 22, 2014

(54) CNG TIME FILL SYSTEM AND METHOD WITH SAFE FILL TECHNOLOGY

(75) Inventor: Denis Ding, Riverside, CA (US)

(73) Assignee: Clean Energy Fuels Corp., Newport Beach, CA (US)

( * ) Notice: Subject to any disclaimer, the term of this patent is extended or adjusted under 35 U.S.C. 154(b) by 766 days.

(21) Appl. No.: 12/981,276

(22) Filed: Dec. 29, 2010

(65) Prior Publication Data

US 2011/0155278 A1 Jun. 30, 2011

(51) Int. Cl.
*B67C 3/00* (2006.01)
*F17C 5/06* (2006.01)

(52) U.S. Cl.
CPC ..... *F17C 5/06* (2013.01)
USPC ..... 141/197; 141/4; 141/39; 141/83; 141/94; 141/95

(58) Field of Classification Search
USPC ..... 141/4, 18, 39, 47, 83, 94, 95, 197; 114/4; 137/110
See application file for complete search history.

(56) References Cited

U.S. PATENT DOCUMENTS 4,527,600 A * 7/1985 Fisher et al. ..... 141/4
5,315,831 A 5/1994 Goode et al.
5,373,702 A 12/1994 Kalet et al.
5,421,162 A 6/1995 Gustafson et al.
5,505,232 A 4/1996 Barclay
5,513,678 A * 5/1996 Schultz et al. ..... 141/4
5,586,050 A 12/1996 Makel et al.
5,615,561 A 4/1997 Houshmond et al.
5,628,349 A * 5/1997 Diggins et al. ..... 141/3
5,682,750 A 11/1997 Preston et al.
5,687,776 A 11/1997 Forgash et al.
5,771,946 A 6/1998 Kooy et al.
5,787,940 A 8/1998 Bonn et al.
5,839,886 A 11/1998 Shaw
5,868,176 A * 2/1999 Barajas et al. ..... 141/83
5,884,488 A 3/1999 Gram et al.
6,044,647 A 4/2000 Drube et al.
6,354,088 B1 3/2002 Emmer et al.
6,571,151 B1 5/2003 Leathermann
6,631,615 B2 10/2003 Drube et al.
6,640,554 B2 11/2003 Emmer et al.
6,882,900 B1 4/2005 Terranova (Continued)

FOREIGN PATENT DOCUMENTS

| | | |
|---|---|---|
| CN | 1304010 | 7/2001 |
| CN | 1713949 | 12/2005 |
| DE | 20 2005 020 648 | 6/2006 |
| WO | WO 01/51846 | 7/2001 |

OTHER PUBLICATIONS

Patent Cooperation Treaty, International Search Report for PCT/US2011/057237, PCT/ISA/210, Jun. 28, 2013, pp. 1-2.

*Primary Examiner* — Timothy L Maust
(74) *Attorney, Agent, or Firm* — Sheppard Mullin Richter & Hampton LLP

(57) ABSTRACT

The present invention provides a CNG time fill system having a compression system including a gas dryer and one or more gas compressors, a gas storage system for storing the natural gas, a manifold time fill system for filling a plurality of natural gas vehicles with the natural gas, a pressure transducer or pressure transmitter for detecting the pressure within the manifold time fill system, and an automatic shut off valve for selectively stopping the flow of gas into the manifold time fill system.

18 Claims, 2 Drawing Sheets

(56) References Cited

U.S. PATENT DOCUMENTS

| | | | | |
|---|---|---|---|---|
| 6,899,146 | B2 | 5/2005 | Bingham et al. | |
| 7,069,730 | B2 | 7/2006 | Emmer et al. | |
| 7,222,647 | B2 | 5/2007 | Bingham et al. | |
| 7,284,575 | B2 | 10/2007 | Gram et al. | |
| 7,289,877 | B2 | 10/2007 | Wilson | |
| 2002/0170297 | A1 | 11/2002 | Quine et al. | |
| 2004/0099138 | A1 | 5/2004 | Karode et al. | |
| 2004/0163731 | A1* | 8/2004 | Eichelberger et al. | 141/284 |
| 2005/0284154 | A1 | 12/2005 | Peter et al. | |
| 2006/0118575 | A1 | 6/2006 | Boyd et al. | |
| 2008/0196384 | A1* | 8/2008 | Ding | 60/39.45 |

* cited by examiner

CNG TIME FILL SYSTEM AND METHOD WITH SAFE FILL TECHNOLOGY

FIELD OF THE INVENTION

The present invention relates generally to compressors for compressed natural gas (CNG) stations for refueling motor vehicles, and more particularly to a CNG time fill system and method with safe fill technology.

BACKGROUND OF THE INVENTION

Most time fill CNG stations are designed to fill multiple natural gas vehicles (NGVs) through a series of CNG hoses connected to a manifold system. A typical compression system (e.g., including gas dryer, gas compressor, gas storage and valve panel) will deliver CNG to the entire manifold including the NGVs connected to the manifold. The compression system will continue to charge the manifold until it reached a calculated target pressure. Due to different configurations (e.g., timing of individual vehicle connections and starting pressure of each vehicle), it is difficult to incorporate safety measures against gas leaks caused by broken fittings, hoses or vehicles with onboard gas leaks.

SUMMARY OF THE INVENTION

The present invention provides a time fill CNG refueling station with safe fill technology. In particular, the invention provides a design and method for measuring and checking for steady static pressure on a time fill manifold system periodically throughout the filling process, thus providing the ability to incorporate safety measures to protect against gas leaks due to broken fittings, hoses or vehicles having onboard gas leaks.

A CNG time fill (also referred to herein as "slow fill") station is designed to fill multiple NGVs through a series of CNG hoses connected to a manifold system. The compression system fills the entire manifold together with all the NGVs connected thereto. In general, it takes multiple hours to fill the NGVs; therefore, it is called slow fill or time fill dispensing system.

One embodiment of the invention is directed toward a CNG time fill system, comprising a compression system including a gas dryer and one or more gas compressors, a gas storage system for storing the natural gas, a manifold time fill system for filling a plurality of natural gas vehicles with the natural gas, a pressure transducer or pressure transmitter for detecting the pressure within the manifold time fill system, and an automatic shut off valve for selectively stopping the flow of gas into the manifold time fill system. As such, the automatic shut off valve isolates the manifold time fill system from the compression system. An amount of storage capacity in the gas storage system is variable based upon compression capacity and number of vehicles.

In the above-described CNG time fill system, the pressure transducer or pressure transmitter detects a pressure measurement downstream of the automatic shut off valve. In addition, the pressure measurement is provided to a programmable logic controller, which determines whether the manifold time fill system is maintaining a steady static pressure. In particular, if the manifold time fill system achieves the predetermined steady state level within a predetermined time, compression is continued until the manifold pressure has reached a target fill pressure. However, if the manifold time fill system fails to achieve a steady static pressure within a predetermined time, the compression system is shut down and a system operator is warned of a potential leak.

Another embodiment of the invention is directed toward a method for providing a CNG time fill system for simultaneously fueling a plurality of natural gas vehicles, comprising: (i) charging a gas storage system such that it is ready for fueling; (ii) opening a time fill valve, turning on a compression system and starting to deliver CNG to a manifold time fill system; (iii) closing the time fill valve and allowing the compression system to continue to fill the gas storage system; (iv) waiting for the manifold time fill system to reach a predetermined steady static pressure; (v) shutting down the compression system and warning a system operator of a potential leak if the manifold pressure fails to achieve the predetermined steady state level within a predetermined continuous period of time; and (vi) continuing to deliver CNG to the manifold time fill system until the manifold pressure has reached a target fill pressure if the predetermined steady static pressure has been achieved for the predetermined continuous period of time.

In the above-described method, CNG is delivered to the manifold time fill system for a predetermined duration based on a number of natural gas vehicles to be fueled, gas storage capacity, and compression capacity. In some cases, the predetermined duration is between 5 minutes and 60 minutes. In some embodiments, warning the system operator of a potential leak comprises sending an alarm to the system operator. The method may further comprise periodically checking and verifying that the manifold time fill system is maintaining a steady state static pressure throughout the entire time fill process.

Other features and advantages of the present invention should become apparent from the following description of the preferred embodiments, taken in conjunction with the accompanying drawings, which illustrate, by way of example, the principles of the invention.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein may illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

Figure 1:
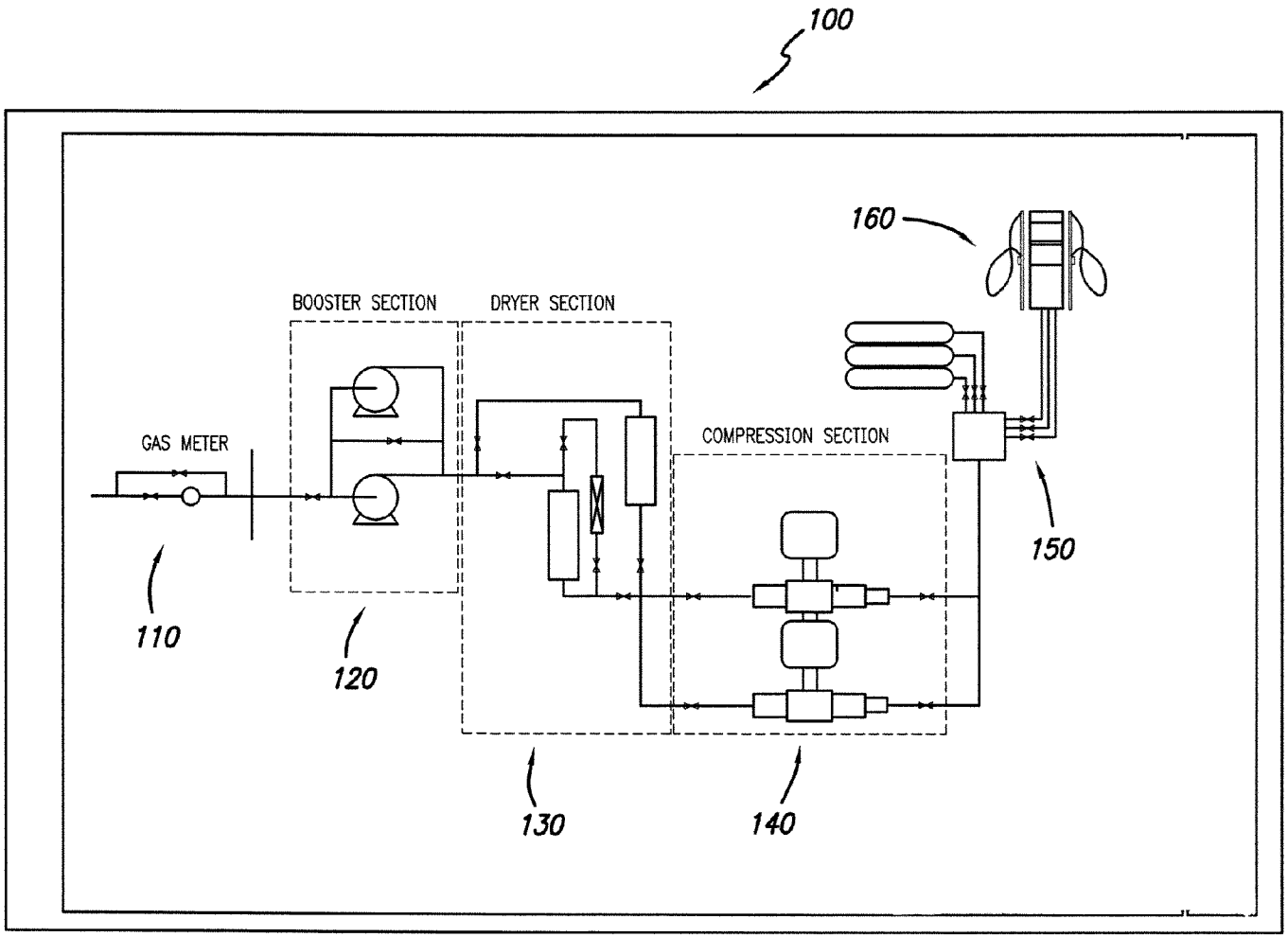

Embodiments of the present invention will now be described, by way of example only, with reference to the following drawings, in which:

FIG. 1 illustrates an exemplary reciprocating compressor system.

Figure 2:
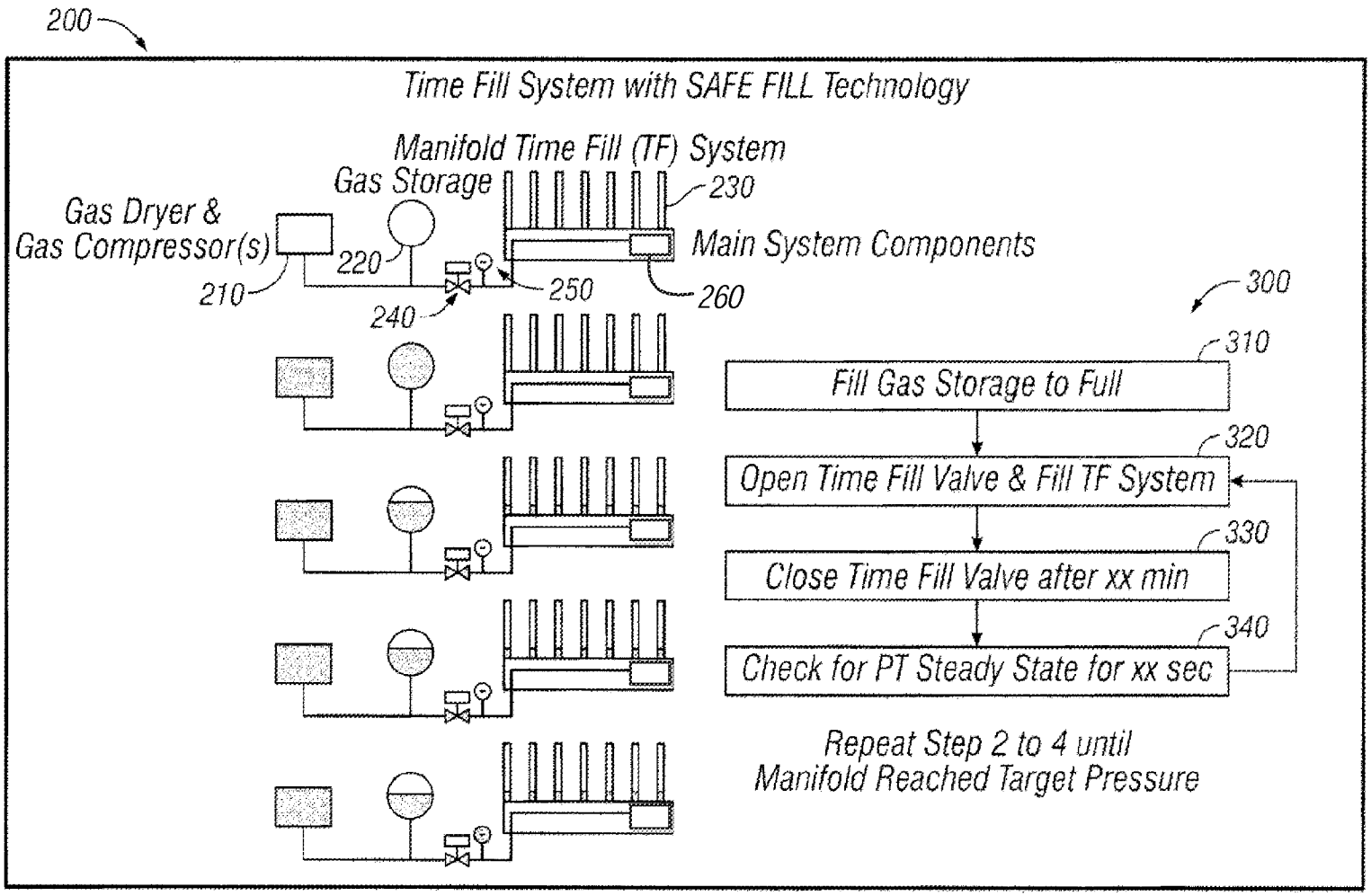

FIG. 2 is a schematic diagram illustrating a CNG time fill system and method with safe fill technology, in accordance with the principles of the present invention.

DETAILED DESCRIPTION OF THE PREFERRED EMBODIMENTS

In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

The present invention is directed to a CNG time fill system with safe fill technology design. Specifically, some embodiments provide a design and method for periodically measuring and checking for steady static pressure on a time fill manifold system throughout the filling process. This provides the ability to incorporate safety measures to protect against gas leaks due to broken fittings, hoses or vehicles having onboard gas leaks.

Referring to FIG. 1, an exemplary reciprocating compressor system 100 is illustrated. Specifically, the system 100 comprises a gas inlet component 110, an optional booster component 120, a drying component 130, a compressor component 140, a valve control panel and storage component 150, and a dispensing component 160. Such as system is described in greater detail in U.S. patent application Ser. No. 11/675,824, the content of which is incorporated herein by reference in its entirety.

With further reference to FIG. 1, the gas inlet component 110 may be provided at the site location by a local gas utility company. In addition, the optional booster component 120 may comprise a single booster, or multiple boosters disposed in parallel. The drying component 130 may comprise a single tower or multiple towers of drying elements having the ability to automatically or manually regenerate itself when it becomes saturated. Additionally, the compressor component 140 may comprise a single high pressure reciprocating compressor, or alternatively may comprise multiple reciprocating compressors disposed in parallel. By way of example, the compressor component may comprise a rotary, single-screw, positive-displacement compressor such as manufactured commercially by Vilter Manufacturing Corporation (Cudahy, Wis.)

With continued reference to FIG. 1, the valve control panel and storage component 150 may comprise a series of control valves that direct the flow of gas from the compressor component 140 to the dispensing component 160, or from the compressor component 140 to local storage vessels. The dispensing component 160 may comprise one or more dispensers such as light duty, medium duty or transit type dispensers and/or time-fill dispensing mechanisms.

Referring to FIG. 2, in accordance with an embodiment of the invention, a CNG time fill system 200 and method 300 with safe fill technology design is illustrated. In particular, the CNG time fill system 200 comprises: (i) a compression system 210 including a gas dryer and one or more gas compressors; (ii) a gas storage system 220; (iii) a manifold time fill system 230; (iv) an automatic shut off valve 240; and (v) a pressure transducer/transmitter 250.

The amount of storage capacity in gas storage 220 varies from site to site and depends on a number of engineering design factors. Such factors include, but are not limited to, compression capacity and number of vehicles. In the manifold time fill system 230, the number of hoses (NGV connection points) varies from site-to-site depending on project requirements. In turn, the size of the manifold depends on the number of hoses, the physical distance and compression capacity.

With further reference to FIG. 2, unlike traditional time fill CNG stations, CNG time fill system 200 includes safe fill technology comprising automatic shut off valve 240 that isolates the manifold time fill system 230 from the compression system 210. The safe fill technology further comprises pressure transducer 250 or pressure transmitter 250 that provides the pressure measurement downstream of the automatic shut off valve 240 to a programmable logic controller (PLC) 260 or other control system.

Embodiments of the present invention focus on the operation of the automatic shut off valve 240 with the pressure transducer/transmitter 250 to provide the static pressure information to the PLC 260 (or other control system) for measurement and verification that the manifold system is maintaining steady static pressure. This information, in turn, can be used as a leak indication. Specifically, if the manifold pressure never achieves a predetermined steady state level within a predetermined time, the system 200 proceeds to shut down the compression and warn the operator of a potential leak (e.g., using an alarm). Some embodiments of the invention may entail a periodic check and verification that the manifold time fill system is maintaining steady state static pressure throughout the entire time fill process. In addition, the principles of the invention can be applied to most existing time fill systems.

Some embodiments of the subject invention are directed toward a natural gas time fill CNG station that has the ability to: (i) measure and check for steady static pressure on the time fill manifold system periodically throughout the filling process; and (ii) incorporate safety measures protection against gas leaks due to broken fittings, hoses or vehicles with onboard gas leak. By measuring and checking for steady static pressure, the station can sound an alarm and/or shut itself down upon the detection of gas leaks in the manifold system.

With continued reference to FIG. 2, a method 300 for providing a CNG time fill system (e.g., system 200) with safe fill technology design will now be described. In operation 310, the gas storage system 220 is charged such that it is ready for fueling. Operation 320 entails opening the time fill valve, turning on the compression system 210 and starting to deliver CNG to the manifold time fill system 230 for a predetermined amount of time. This amount of time depends on the number of vehicles to be fueled, gas storage capacity, and compression capacity. As such, the predetermined amount of time may vary be between 5 minutes and 60 minutes. In operation 330, the time fill valve is closed allowing the compressor(s) to continue to fill the gas storage 220.

With further reference to FIG. 2, operation 340 involves waiting for the manifold time fill system 230 to reach a steady static pressure. In particular, if the manifold pressure never achieves a predetermined steady state level within a predetermined time, the system 200 proceeds to shut down compression and warn the operator of a potential leak (e.g., using an alarm). If, however, the predetermined steady static pressure is achieved for a predetermined continuous period of time, operation 320 is repeated until the manifold pressure has reached its target fill pressure. In some embodiments of the invention, an additional operation may include periodically checking and verifying that the manifold time fill system is maintaining a steady state static pressure throughout the entire time fill process.

One skilled in the art will appreciate that the present invention can be practiced by other than the various embodiments and preferred embodiments, which are presented in this description for purposes of illustration and not of limitation, and the present invention is limited only by the claims that follow. It is noted that equivalents for the particular embodiments discussed in this description may practice the invention as well.

While various embodiments of the present invention have been described above, it should be understood that they have been presented by way of example only, and not of limitation. Likewise, the various diagrams may depict an example architectural or other configuration for the invention, which is done to aid in understanding the features and functionality that may be included in the invention. The invention is not restricted to the illustrated example architectures or configurations, but the desired features may be implemented using a variety of alternative architectures and configurations. Indeed, it will be apparent to one of skill in the art how alternative functional, logical or physical partitioning and configurations may be implemented to implement the desired features of the present invention. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, may be combined in a single package or separately maintained and may further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives may be implemented without confinement to the illustrated examples. For example, block diagrams and their accompanying description should not be construed as mandating a particular architecture or configuration.

What is claimed is:

1. A compressed natural gas (CNG) time fill system, comprising:

a compression system including a gas dryer and one or more gas compressors;

a gas storage system for storing CNG;

a manifold time fill system for filling a plurality of natural gas vehicles with CNG;

a pressure transducer or pressure transmitter for periodically detecting the pressure within the manifold time fill system to check for steady static pressure within the manifold time fill system during the flow of CNG through the manifold time fill system; and an automatic shut off valve for selectively stopping the flow of CNG into the manifold time fill system allowing the compression system to fill the gas storage system after a predetermined time and shutting the compression system down when the manifold time fill system fails to achieve the steady static pressure within a predetermined time, while repeatedly allowing the compression system to continue to deliver CNG to the manifold time fill system as long as the manifold time fill system achieves the predetermined steady state level within the predetermined time until the pressure within the manifold time fill system has reached a target fill pressure.

2. The CNG time fill system of claim 1, wherein an amount of storage capacity in the gas storage system is variable based upon compression capacity and number of vehicles.

3. The CNG time fill system of claim 1, wherein the automatic shut off valve isolates the manifold time fill system from the compression system.

4. The CNG time fill system of claim 1, wherein the pressure transducer or pressure transmitter detects a pressure measurement downstream of the automatic shut off valve.

5. The CNG time fill system of claim 4, wherein the pressure measurement is provided to a programmable logic controller.

6. The CNG time fill system of claim 5, wherein the programmable logic controller determines whether the manifold time fill system is maintaining the steady static pressure.

7. The CNG time fill system of claim 6, wherein if the manifold time fill system fails to achieve the steady static pressure within the predetermined time, a system operator is warned of a potential leak.

8. A method for providing a compressed natural gas (CNG) time fill system for simultaneously fueling a plurality of natural gas vehicles, comprising:

charging a gas storage system such that it is ready for fueling;

opening a time fill valve, turning on a compression system and starting to deliver CNG to a manifold time fill system;

closing the time fill valve and allowing the compression system to continue to fill the gas storage system;

waiting for the manifold time fill system to reach a predetermined steady static pressure;

shutting down the compression system and warning a system operator of a potential leak if pressure within the manifold time fill system fails to achieve the predetermined steady static pressure within a predetermined continuous period of time; and continuing to deliver CNG to the manifold time fill system until the pressure within the manifold time fill system has reached a target fill pressure if the predetermined steady static pressure has been achieved for the predetermined continuous period of time.

9. The method of claim 8, wherein CNG is delivered to the manifold time fill system for a predetermined duration.

10. The method of claim 9, wherein the predetermined duration is based on a number of natural gas vehicles to be fueled, gas storage capacity, and compression capacity.

11. The method of claim 9, wherein the predetermined duration is between 5 minutes and 60 minutes.

12. The method of claim 8, wherein warning the system operator of a potential leak comprises sending an alarm to the system operator.

13. The method of claim 8, further comprising periodically checking and verifying that the manifold time fill system is maintaining a steady state static pressure throughout the entire time fill process.

14. A compressed natural gas (CNG) time fill system, comprising:

a compression system including a gas dryer and one or more gas compressors;

a gas storage system for storing CNG;

a manifold time fill system for filling a plurality of natural gas vehicles with the CNG;

an automatic shut off valve for selectively stopping the flow of CNG into the manifold time fill system by isolating the manifold time fill system from the compression system and allowing the compression system to fill the gas storage system after a predetermined time and shutting the compression system down when the manifold time fill system fails to achieve the steady static pressure within the predetermined time, while repeatedly allowing the compression system to continue to deliver CNG to the manifold time fill system as long as the manifold time fill system achieves the predetermined steady state level within the predetermined time until the pressure within the manifold time fill system has reached a target fill pressure; and a pressure transducer or pressure transmitter for periodically detecting the pressure within the manifold time fill system downstream of the automatic shut off valve to check for the steady static pressure within the manifold time fill system during the flow of CNG through the manifold time fill system.

15. The CNG time fill system of claim 14, wherein an amount of storage capacity in the gas storage system is variable based upon compression capacity and number of vehicles.

16. The CNG time fill system of claim 14, wherein the pressure measurement is provided to a programmable logic controller.

17. The CNG time fill system of claim 16, wherein the programmable logic controller determines whether the manifold time fill system is maintaining the steady static pressure.

18. The CNG time fill system of claim 17, wherein if the manifold time fill system fails to achieve the steady static pressure within the predetermined time, a system operator is warned of a potential leak.

* * * * *